US005855537A

United States Patent [19]

Coody et al.

[11] Patent Number: 5,855,537

[45] Date of Patent: Jan. 5, 1999

[54] POWERED FOLDING TREADMILL APPARATUS AND METHOD

[75] Inventors: Bruce F. Coody; Thomas C. Coburn, both of Auburn, Ala.

[73] Assignee: FF Acquisition Corp., West Point, Miss.

[21] Appl. No.: 745,449

[22] Filed: Nov. 12, 1996

[51] Int. Cl.[6] ..... A63B 22/02

[52] U.S. Cl. ..... 482/54; 482/51

[58] Field of Search ..... 482/51, 54

[56] References Cited

U.S. PATENT DOCUMENTS

| | | |
|---|---|---|
| D. 207,541 | 5/1967 | Hesen . |
| D. 211,801 | 7/1968 | Quinton . |
| D. 217,173 | 4/1970 | Frasier . |
| D. 270,555 | 9/1983 | Ogden . |
| D. 277,304 | 1/1985 | Smith et al. . |
| D. 283,239 | 4/1986 | Smith et al. . |
| 284,294 | 9/1883 | Graves . |
| D. 284,597 | 7/1986 | Smith et al. . |
| D. 304,849 | 11/1989 | Watterson . |
| D. 306,468 | 3/1990 | Watterson . |
| D. 306,891 | 3/1990 | Watterson . |
| D. 316,124 | 4/1991 | Dalebout et al. . |
| 321,388 | 6/1885 | Ruebsam . |
| D. 323,009 | 1/1992 | Dalebout et al. . |
| D. 323,198 | 1/1992 | Dalebout et al. . |
| D. 323,199 | 1/1992 | Dalebout et al. . |
| D. 344,112 | 2/1994 | Smith . |
| D. 344,557 | 2/1994 | Ashby . |
| D. 348,493 | 7/1994 | Ashby . |
| D. 348,494 | 7/1994 | Ashby . |
| D. 351,202 | 10/1994 | Bingham . |
| D. 351,633 | 10/1994 | Bingham . |
| D. 356,128 | 3/1995 | Smith et al. . |
| D. 358,437 | 5/1995 | Wang et al. . |
| D. 361,806 | 8/1995 | Bartlett . |
| D. 361,807 | 8/1995 | Bartlett . |
| 659,216 | 10/1900 | Durham . |

(List continued on next page.)

FOREIGN PATENT DOCUMENTS

| | | |
|---|---|---|
| 0 095 226 | 3/1983 | European Pat. Off. . |
| 1468272 | 2/1966 | France . |
| 7131842 | 4/1973 | France . |
| 83466 | 8/1908 | Germany . |
| 2 215 119 | 11/1973 | Germany . |
| 2 225 342 | 12/1973 | Germany . |
| 24 08 052 | 8/1975 | Germany . |
| 51-10842 | 3/1976 | Japan . |
| 56-56358 | 5/1981 | Japan . |
| 56-150562 | of 1989 | Japan . |
| 825122 | 7/1977 | Russian Federation . |
| 1248615 A1 | 7/1986 | U.S.S.R. . |
| 1169148 | 10/1969 | United Kingdom . |
| 1326263 | 8/1973 | United Kingdom . |
| 1505702 | 3/1978 | United Kingdom . |
| 2 120 560 | 12/1983 | United Kingdom . |
| WO 80/00099 | 6/1981 | WIPO . |

OTHER PUBLICATIONS

Advertisment for Sportmart Health & Fitness for the "The Step" (Sportmart Health & Fitness, Jan. 23, 1993, 1 pg.).

"Advertisement for The Step and The Step II" (Sears The Great American Wish Book 1991, 2pp.).

(List continued on next page.)

*Primary Examiner*—Lynne A. Reichard
*Attorney, Agent, or Firm*—Brinks Hofer Gilson & Lione

[57] ABSTRACT

A foldable treadmill is provided with a powered folding capability. The treadmill has a support and a track bed. The front end of the track bed is disposed pivotally to the support, and an incline motor connects to the support and to the track bed. The motor is operated to fold or unfold the track bed. The track bed back end can be raised or lowered, and the incline of the track bed can be adjusted up or down at the front end of the track bed. The support can be an upright support. A slot is formed in the upright support. The track bed adjustably connects to the slot. As the incline of a track bed is adjusted with the incline motor, the track bed is guided in the slot.

14 Claims, 5 Drawing Sheets

U.S. PATENT DOCUMENTS 663,486 12/1900 Boren .
881,521 3/1908 Wilson .
931,394 8/1909 Day .
1,020,777 3/1912 Peterson .
1,064,968 6/1913 Hagen .
1,082,940 12/1913 Flora .
1,715,870 6/1929 Spain .
1,778,635 10/1930 Heisler .
1,824,406 9/1931 Petersime .
1,850,530 3/1932 Brown .
1,902,694 3/1933 Edwards .
1,928,089 9/1933 Blickman .
1,973,945 9/1934 Chavin et al. .
2,145,940 2/1939 Marlowe .
2,440,644 4/1948 Powell .
2,470,544 5/1949 Bell .
2,642,288 6/1953 Bell .
2,714,507 8/1955 Goodrich .
2,855,200 10/1958 Blickman .
2,874,971 2/1959 Devery .
2,924,458 2/1960 Miller .
3,127,171 3/1964 Noland et al. .
3,378,259 4/1968 Kupchinski .
3,446,503 5/1969 Lawton .
3,586,322 6/1971 Kverneland .
3,589,715 6/1971 Mark .
3,606,320 9/1971 Erwin, Jr. .
3,614,097 10/1971 Blickman .
3,642,279 2/1972 Cutter .
3,650,529 3/1972 Salm et al. .
3,659,845 5/1972 Quinton .
3,731,917 5/1973 Townsend .
3,738,649 6/1973 Miller .
3,741,538 6/1973 Lewis et al. .
3,751,033 8/1973 Rosenthal .
3,826,491 7/1974 Elder .
3,858,938 1/1975 Kristensson et al. .
3,874,657 4/1975 Niebojewski .
3,892,404 7/1975 Martucci .
3,918,710 11/1975 Niebojewski .
3,963,101 6/1976 Stadelmann et al. .
3,966,182 6/1976 Stadelmann et al. .
3,976,058 8/1976 Tidwell .
4,026,545 5/1977 Schonenberger .
4,043,552 8/1977 Kerkonian .
4,066,257 1/1978 Moller .
4,093,196 6/1978 Bauer .
4,170,351 10/1979 Ozbey et al. .
4,176,836 12/1979 Coyle .
4,188,030 2/1980 Hooper .
4,248,476 2/1981 Phelps .
4,300,760 11/1981 Bobroff .
4,300,761 11/1981 Howard .
4,344,616 8/1982 Ogden .
4,374,587 2/1983 Ogden .
4,383,714 5/1983 Ishida .
4,406,451 9/1983 Gaetano .
4,422,635 12/1983 Herod et al. .
4,445,683 5/1984 Ogden .
4,452,448 6/1984 Ausherman .
4,502,679 3/1985 De Lorenzo .
4,544,153 10/1985 Babcock .
4,572,500 2/1986 Weiss .
4,576,352 3/1986 Ogden .
4,591,147 5/1986 Smith et al. .
4,625,962 12/1986 Street .
4,635,927 1/1987 Shu .
4,635,928 1/1987 Ogden et al. .
4,641,833 2/1987 Trethewey .
4,643,418 2/1987 Bart .
4,664,371 5/1987 Viander .
4,664,646 5/1987 Rorabaugh .
4,679,787 7/1987 Guilbault ..... 482/54
4,682,750 7/1987 Rudolph et al. .
4,684,126 8/1987 Dalebout et al. .
4,709,918 12/1987 Grinblat .
4,729,558 3/1988 Kuo .
4,751,755 6/1988 Carey, Jr. et al. .
4,757,987 7/1988 Allemand .
4,759,540 7/1988 Yu et al. .
4,776,582 10/1988 Ramhorst .
4,792,134 12/1988 Chen .
4,805,901 2/1989 Kulick .
4,809,976 3/1989 Berger .
4,813,743 3/1989 Mizelle .
4,817,939 4/1989 Augspurger et al. .
4,826,153 5/1989 Schalip .
4,844,449 7/1989 Truslaske ..... 482/54
4,886,266 12/1989 Trulaske .
4,905,330 3/1990 Jacobs .
4,913,396 4/1990 Dalebout et al. .
4,913,423 4/1990 Farran et al. .
4,921,247 5/1990 Sterling .
4,938,473 7/1990 Lee et al. .
4,974,831 12/1990 Dunham .
4,984,810 1/1991 Stearns et al. .
4,998,725 3/1991 Watterson et al. .
5,002,271 3/1991 Gonzales .
5,007,630 4/1991 Real et al. .
5,029,801 7/1991 Dalebout et al. .
5,058,881 10/1991 Measom .
5,072,928 12/1991 Stearns et al. .
5,085,426 2/1992 Wanzer et al. .
5,102,380 4/1992 Jacobson et al. .
5,109,778 5/1992 Berkowitz et al. .
5,110,117 5/1992 Fisher et al. .
5,156,650 10/1992 Bals .
5,163,885 11/1992 Wanzer et al. .
5,178,599 1/1993 Scott .
5,184,988 2/1993 Dunham .
5,192,255 3/1993 Dalebout et al. .
5,207,622 5/1993 Wilkinson et al. .
5,207,628 5/1993 Graham .
5,254,067 10/1993 Habing et al. .
5,282,776 2/1994 Dalebout .
5,299,992 4/1994 Wilkinson .
5,299,997 4/1994 Chen .
5,306,218 4/1994 Chen .
5,330,404 7/1994 Lopeteguy et al. .
5,336,146 8/1994 Piaget et al. .
5,338,277 8/1994 Yang .
5,342,269 8/1994 Huang et al. .
5,344,372 9/1994 Hung .
5,352,167 10/1994 Ulicny .
5,352,169 10/1994 Eschenbach .
5,356,357 10/1994 Wang et al. .
5,366,428 11/1994 Liao .
5,370,594 12/1994 Grinblat .
5,372,559 12/1994 Dalebout et al. .
5,378,212 1/1995 Pin-Kuo .
5,407,408 4/1995 Wilkinson .
5,421,795 6/1995 Chen .
5,423,731 6/1995 Chen .
5,429,568 7/1995 Chen .
5,441,467 8/1995 Stevens .
5,447,479 9/1995 Gvoich .
5,453,066 9/1995 Richter, Jr. .
5,464,378 11/1995 Yu .
5,476,431 12/1995 Wilkinson et al. .
5,518,471 5/1996 Hettinger et al. .
5,607,375 3/1997 Dalebout et al. .
5,662,557 9/1997 Watterson et al. ..... 482/54

| | | | |
|---|---|---|---|
| 5,669,857 | 9/1997 | Watterson et al. | 482/54 |
| 5,672,140 | 9/1997 | Watterson et al. | 482/54 |
| 5,674,156 | 10/1997 | Watterson et al. | 482/54 |
| 5,674,453 | 10/1997 | Watterson et al. | 482/54 |
| 5,676,624 | 10/1997 | Watterson et al. | 482/54 |
| 5,683,332 | 11/1997 | Watterson et al. | 482/54 |
| 5,702,325 | 12/1997 | Watterson et al. . | |
| 5,704,879 | 1/1998 | Watterson et al. . | |
| 5,718,657 | 2/1998 | Dalebout et al. . | |

OTHER PUBLICATIONS

Advertising for "Introducing The New Step Rebook™ Platform" Designed To Meet The Demands Of The Health Club Industry, (©1993 Reebook International Ltd., 1pg.).

Advertisement for "Step II" (Winter 1995 Home Fitness Buyers Guide, pg. 69).

Diagram of "HealthRider®" Parts Description (Apr. 26, 1994, 1 pg.).

Voit Advertisement "Body Jack" (Damark, Nov. 1–4, 1994, 1pg.).

Voit Advertisement "Gravity Rider" with enlarged photocopy (Damark, Jul. 28–Aug. 1, 1994, 2 pp.).

Voit Adertisement "Gravity Ridger" (Damark, Jul. 28, 1994, 2 pp.).

Owner's Manual for "PRO–FORM® CROSS WALK® advantage" (©1994 ICON Health & Fitness, Inc. 18 pp.).

Copy of brochure entitled "Technology For Total Fitness GENESIS 1000™" (GENESIS, Inc., 1985, 6 pp.).

Copy of brochure entitled "Technology For Total Fitness GENESIS 2000™" (GENESIS, Inc., 1985), (pp. P004577–P004582, 6 pp.).

Copy of brochure entitled "Technology For Total Fitness Genesis 3000™"(GENESIS, Inc., 1985), (pp. P004593–P004594 & P004589–P004592, 6 pp.).

Copy of brochure entitled "Technology For Total Fitness GENESIS 4000™" (GENESIS, Inc., 1985). (pp. P004583, 6 pp.).

Copy of brochure for GENESIS 1000™, Technology for Total Fitness entitled "The Optimum Performance Home Fitness Center" (©GENESIS, Inc. Sep. 1985, 1 pg.).

Copy of brochure for GENESIS 2000™, Technology for Total Fitness entitled "The Ultimated in Home Exercise Equipment" (©GENESIS, Inc. Sep. 1985, 2 pp.).

Copy of brochure for GENESIS 3000™, Technology for Total Fitness entitled "The Dynamic Answer to Home Fitness and Health" (©GENESIS, Inc. Sep. 1985, 1 pg.).

Copy of brochure for GENESIS 4000™, Technology for Total Fitness entitled "The Modern Approach to Home Fitness and Health" (©GENESIS, Inc. Sep. 1985, 2 pp.).

Copy of brochure for GENESIS 5000™, Technology for Total Fitness entitled "The Advancement In Home Fitness and Convenience" (©GENESIS, Inc. /85, 1 pg.).

Copy brochure for GENESIS 5000™, Technology for Total Fitness entitled "The Advancement In Home Fitness and Convenience" (©GENESIS, Inc. /85, 1pg.).

Copy of brochure for GENESIS 6000™, Technology for Total Fitness entitled "Maximum Workout in Minimal Space" (©GENESIS, Inc. /85, 1pg.).

Copy of brochure for Vitamaster.® 1988 Product Line entitled "*Vitamaster*®" (Vitamaster Industries, Inc., 1988, 10 pp).

Copy of brochure for Roamaster Fitness Equipment 1989 (Roadmaster Corporation 1989, 6 pp).

Weslo color photos 1995/1996 Treadmill (4 sheets of colored photos).

POWERED FOLDING TREADMILL APPARATUS AND METHOD

FIELD OF THE INVENTION

The invention relates to an improved treadmill apparatus and method of operating the same. In particular, this invention relates to a treadmill design that allows the track bed to be folded to an upright position when not in use.

BACKGROUND OF THE INVENTION

Treadmills are a well-known class of exercising machines that are typically difficult to store because of their awkward shape and size. In general, treadmills include a track bed and a support structure with handle bars. Most treadmills also include a console. Various designs for folding and collapsing treadmills have been or are in present use. Many of these designs are for treadmills with a non-powered tread or track. For example, U.S. Pat. No. 931,394 was an early design of a non-powered track foldable treadmill, which discloses a track bed hinged at its forward end to support legs. The simplicity of this design is not easily translatable to a heavier modern treadmill.

One problem with folding a modern treadmill is that the track bed is generally heavier because of various features, including a motor and drive mechanism. The heavy track bed is difficult to manually lift to the upright position and may cause back strain or other injury. It would be desirable to have a track bed that would raise and lower itself.

Many treadmills have motor driven incline adjustments. Such adjustments are attached to the bottom of the track bed. The adjustments typically have wheels connected to a lever assembly. The wheels rest on the ground or floor. The wheels and lever assembly are driven forward or backward by the motor to adjust the level of incline. For treadmills with an incline adjustment on the front end, the entire treadmill front end is lifted or lowered. Thus, the adjustment must lift any upright supports and handles.

There are several problems with such motor driven incline adjustments. The adjustments add weight to the track bed and make the track bed more difficult to fold. Often, the incline adjustment obstructs the movement of the track bed making it more difficult or impossible to fold. Further, the weight of the incline adjustment on the track bed and the supports attached to the track bed add to the weight lifted or lowered to adjust the incline. It would be desirable to have a foldable treadmill with an incline adjustment. A treadmill with an incline adjustment that does not add weight to the track bed is also desirable. Further, a treadmill with better structural support is desirable.

SUMMARY OF THE INVENTION

The invention provides a treadmill and methods of manufacturing and operating the treadmill. In one aspect a foldable treadmill is provided with a powered folding capability. The treadmill has a support and a track bed. The front end of the track bed is disposed pivotally to the support, and an incline motor connects to the support and to the track bed. The motor is operated to fold or unfold the track bed.

In another aspect of the invention, a foldable treadmill with a track bed front end incline adjustment is provided. A track bed front end is foldably connected to a support, and an incline adjustment connects to the front end. The track bed back end can be raised or lowered, and the incline of the track bed can be adjusted up or down at the front end of the track bed.

In yet another aspect of the invention, an adjustable incline treadmill with an upright support is provided. A track bed adjustably connects to the upright support, and an incline motor connects to the support. The incline motor also connects to the track bed. The incline motor is operated to raise or lower the front end of the track bed.

Another aspect of the invention provides for an adjustable incline treadmill with an upright support having a guide slot. A slot is formed in the upright support. A track bed adjustably connects to the slot, and an incline motor connects to the track bed. As the incline of a track bed is adjusted with the incline motor, the track bed is guided in the slot.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 2:
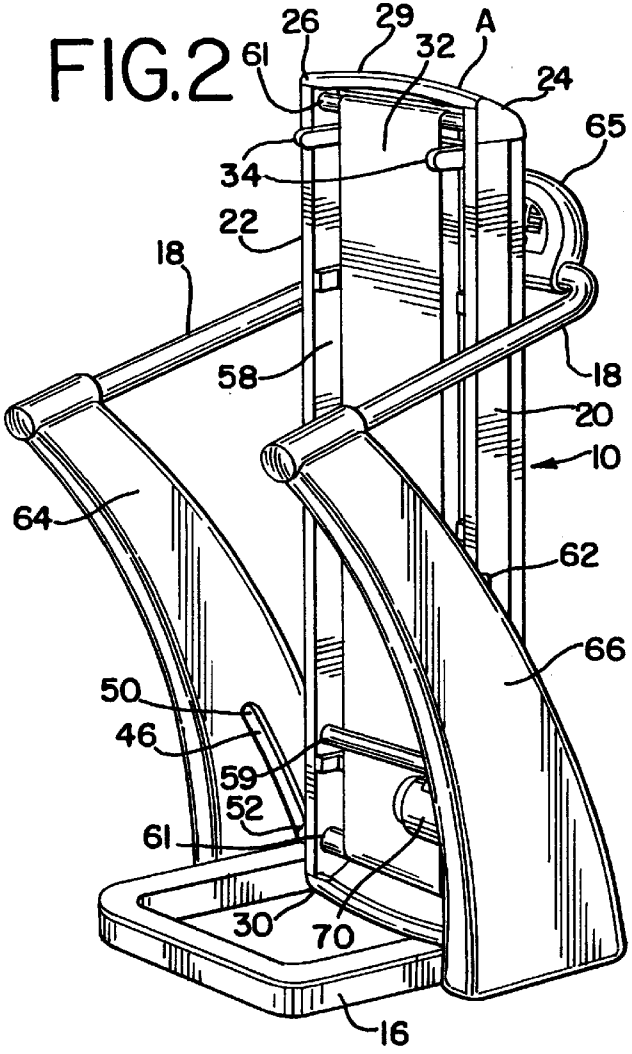
FIG. 2 is a perspective view of a preferred embodiment of the invention with the track bed in a folded position.
Figure 1:
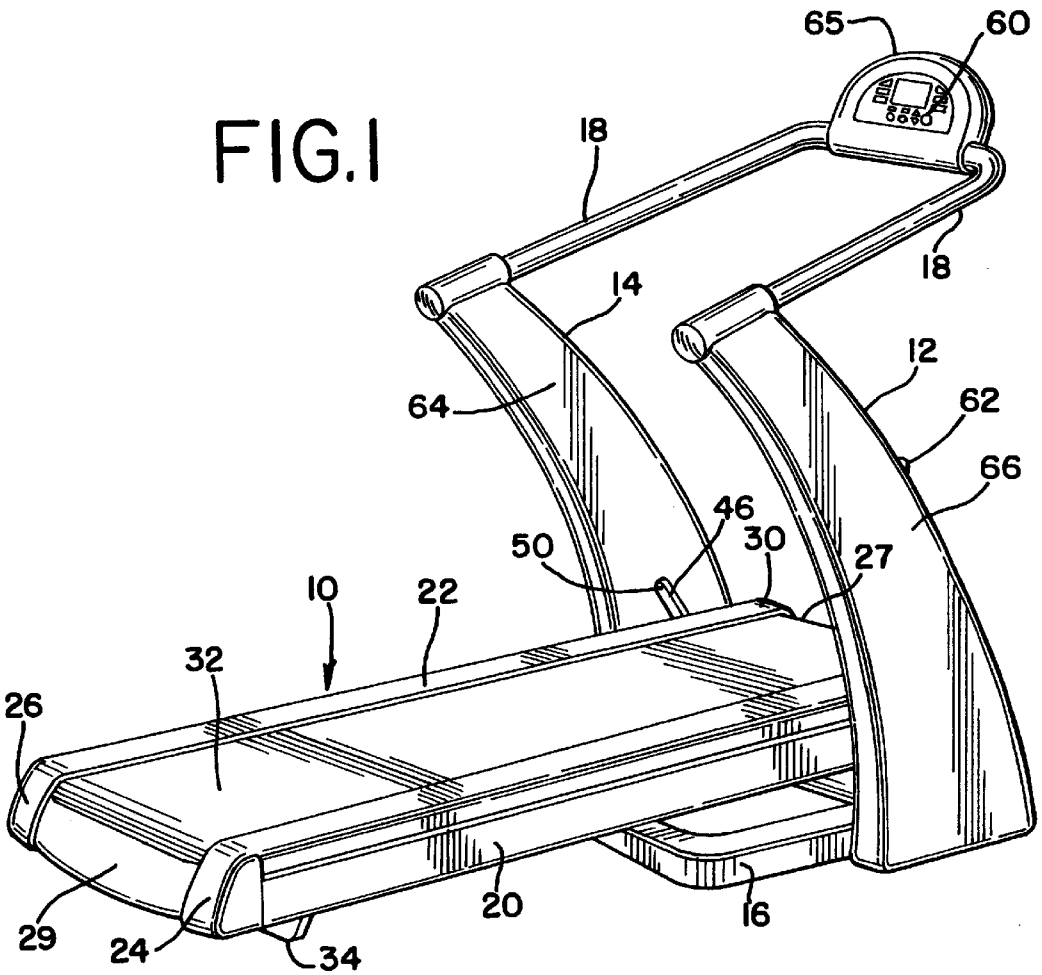
FIG. 1 is a perspective view of a preferred embodiment of the invention with the track bed in an operation or down position.
Figure 3:
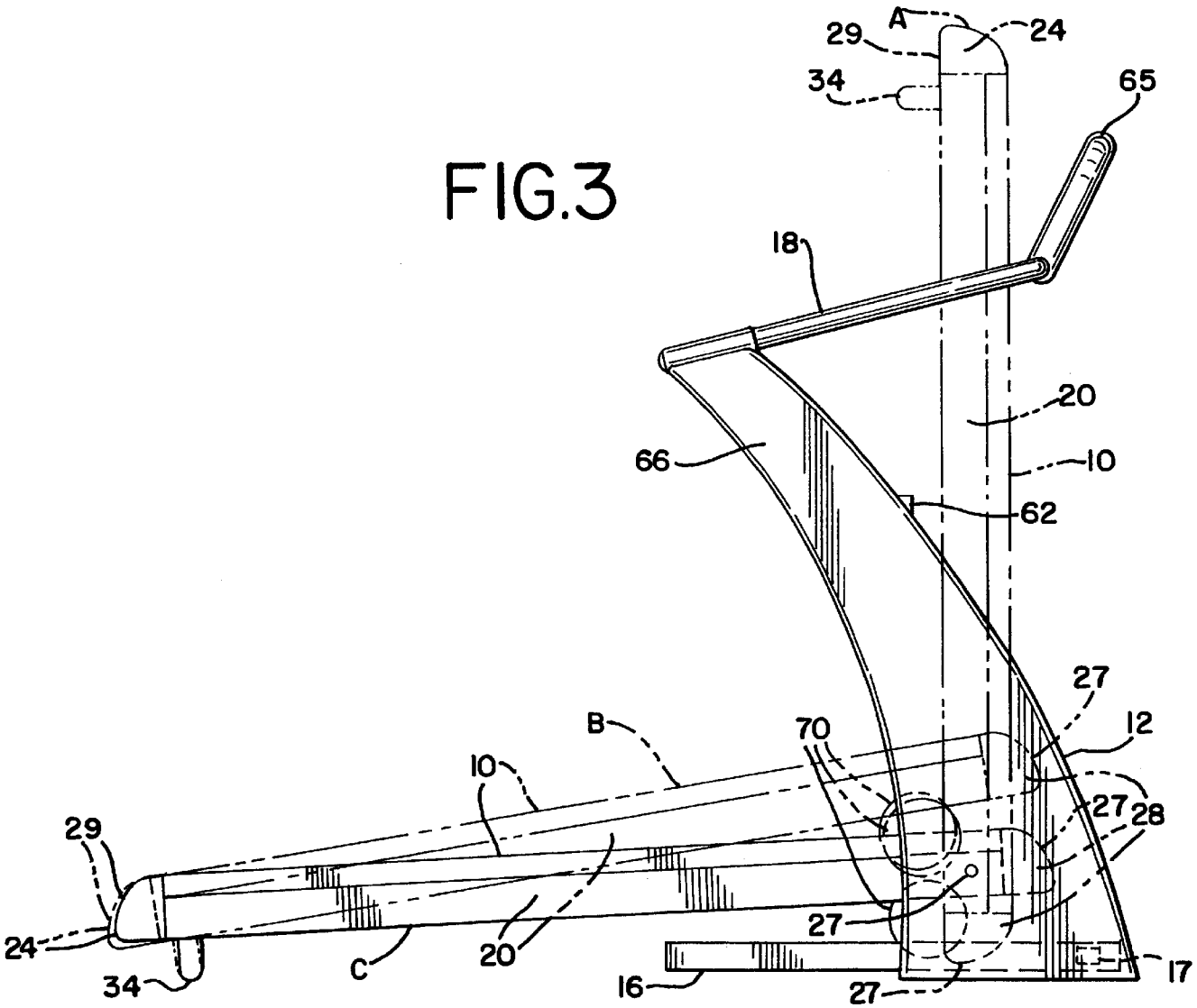
FIG. 3 is a side view of a preferred embodiment of the invention with the track bed in a least decline use position C and in phantom with the track bed in folded position A and in inclined position B.

Referring to FIGS. 1–3, a preferred embodiment of the treadmill is shown having a track bed 10, upright support legs 12, 14, base support 16, and handle 18. Track bed 10 has side rails 20, 22, rear end caps 24, 26, and front end caps 28, 30. Track bed 10 also has a tread 32. A back end support 34 extends from the track bed 10. The back end support 34 rests on the ground or other supporting surface during use of the treadmill. The construction of track bed 10 is known in the art. Generally, parallel frame tubes 58 (see FIGS. 6 and 7) are connected with frame cross tubes 59 to create a track bed frame.

The track bed frame supports the various components described above and other components, such as tread rollers 61. One such component is the tread drive motor and housing 70 (see FIGS. 3 and 5). The tread drive motor and housing 70 is preferably placed in a forward position on the track bed 10 as shown in FIG. 3, but may also be placed forward of the pivot point 27 for folding the track bed 10 to add balance to the track bed 10.

The base support 16 is preferably formed of rectangular steel tubing. The base support 16 is shaped as a square with one open side. A cross tube 17 is placed on the open side and connected to the base support 16. The base support 16 should be broad enough to keep the treadmill standing even if bumped and to support the treadmill as the track bed 10 is raised or lowered. In one embodiment, the base support is approximately twenty-eight (28) inches long parallel to the track bed. Other lengths could be used.

Wheels (not shown) could be placed on one side of base support 16. For example, two wheels are preferably placed on the side of base support 16 that connects to upright support leg 12. The wheels would face perpendicular to the track bed 10. Further, the wheels could be suspended slightly above the floor. Thus, in the folded position as shown in FIG. 2, the treadmill could be rolled side ways through a door way by raising the side opposite the wheels off of the floor or ground. The wheels would then contact the ground allowing the treadmill to roll.

Figure 5:
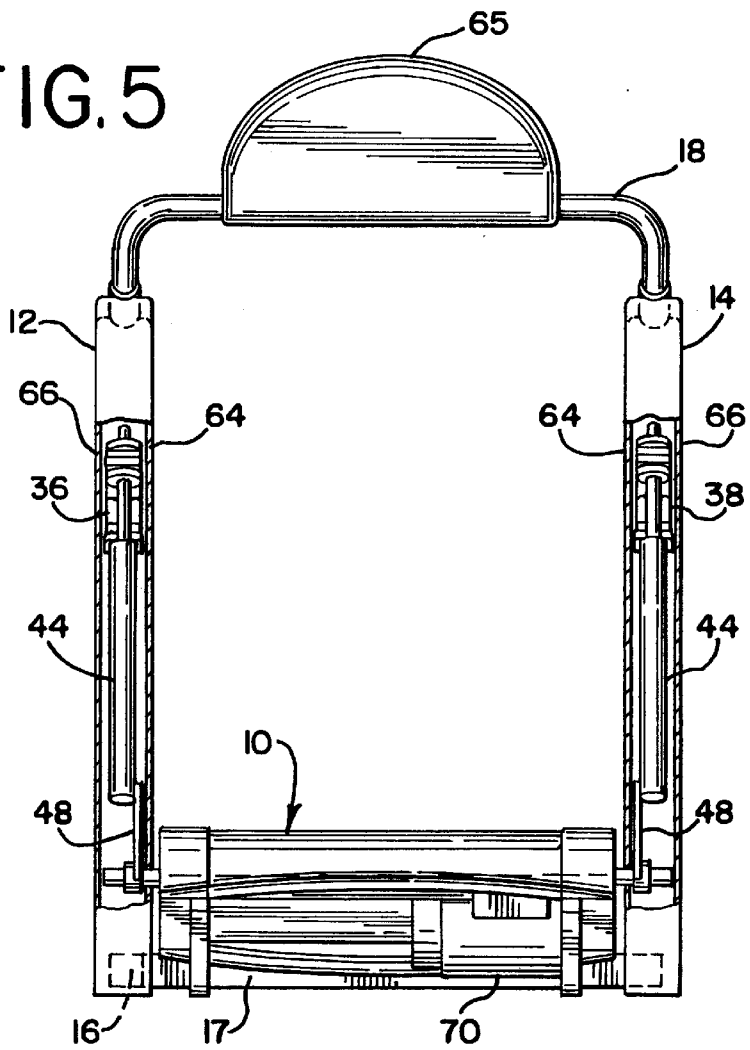
FIG. 5 is a front view of a preferred embodiment of the invention with the inside of the upright supports exposed.
Figure 4:
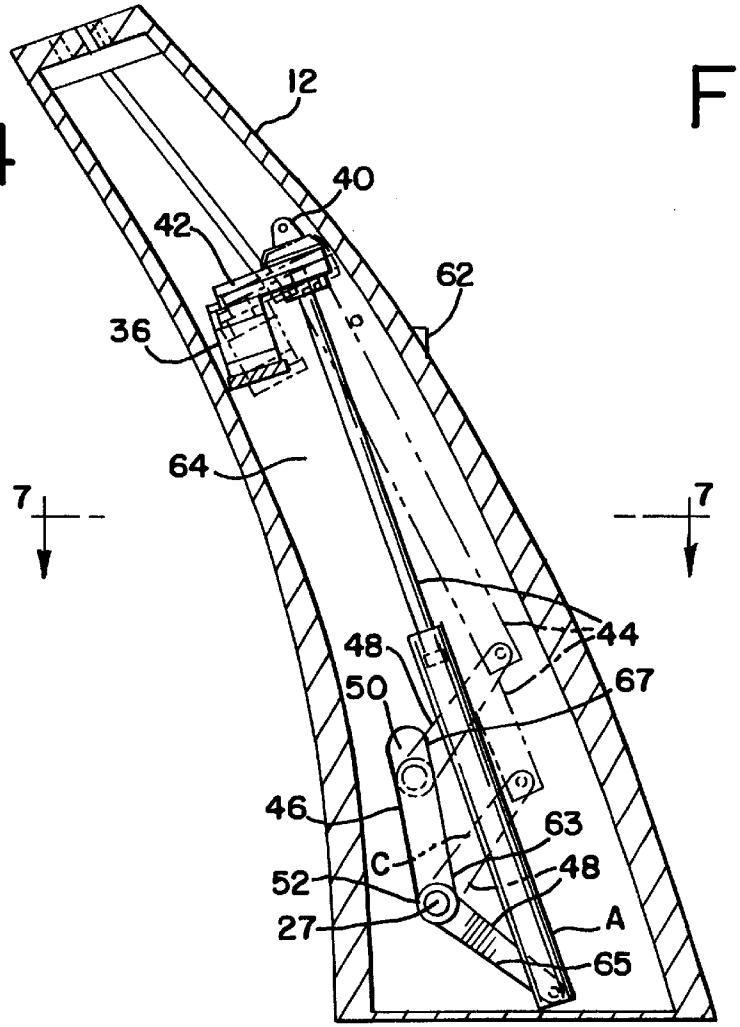
FIG. 4 is a side view in cross section of a preferred embodiment of the upright support of the present invention, shown with the linear actuator in the track bed folded position A and in phantom with the linear actuator in two different incline positions for use of the track bed, including least incline position C.
Figure 7:
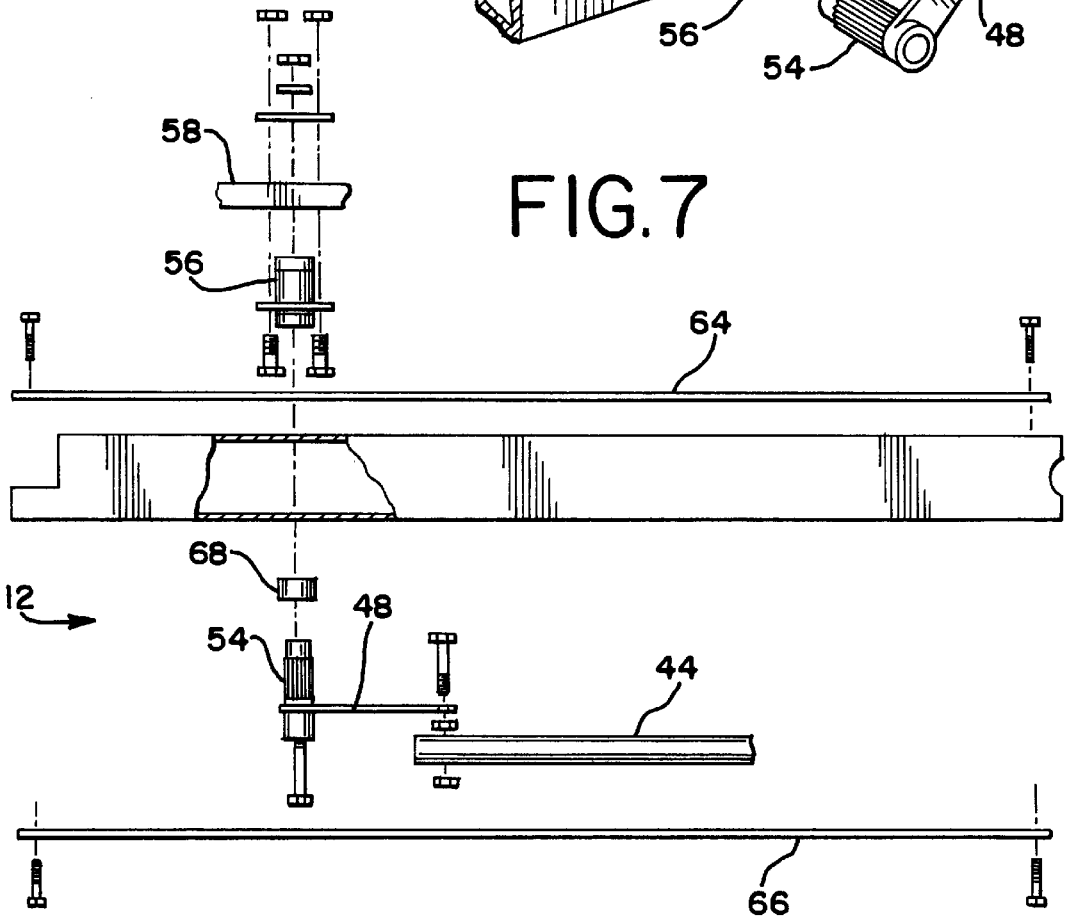
FIG. 7 is an exploded sectional cut away top view of a preferred embodiment of the lever arm, upright support leg and track bed of FIG. 4.

Referring now to FIGS. 4–5 and 7, the upright support legs 12, 14 are shown. Preferably, the upright support legs 12, 14 are also made of rectangular steel tubing. Structural foam and other rigid materials could be used. The tubing is welded and forms an outline of the upright support legs 12, 14. A metal, preferably steel, plate 64 is welded or screwed to one side of the tubing. A plastic plate 66 is screwed onto the other side of the tubing. The upright supports 12, 14 are bolted to the base support 16. The handle 18 is bolted onto the upright supports 12, 14.

The metal plate 64 has a slot 46. Slot 46 has a slot top 50 and a slot bottom 52. The slot may be any size compatible with lever arm 48. In one embodiment, the slot 46 is approximately one and a half (1½) inches wide and six and a half (6½) inches from the slot top 50 centerline to the slot bottom 52 centerline. The length is based on the amount of incline sought for the treadmill. Further, slot 46 preferably has a curved shape based on the length of the track bed 10, such as a fifty-two (52) inch radius in one embodiment.

Incline motors 36, 38 are mounted within upright supports 12, 14, respectively. For the sake of brevity, the remaining description will explain the construction of upright support leg 12 only (unless noted otherwise). It should be understood that upright support leg 14 is of the same construction.

The incline motor 36 is pivotally connected to upright support leg 12. Preferably, a bolt is welded onto the inside of the metal plate 64. The incline motor 36 has a bolt connector 40. The incline motor 36 is rotatably connected to the upright support 12 by screwing the bolt connector 40 onto the welded bolt.

Incline motor 36 is electrically connected to an incline switch 60 and a fold switch 62. Switch 60 is positioned on console 65, which in turn is bolted to the handle 18. The wiring for switch 60 preferably runs through the handle 18, into upright support leg 12 and connects to incline motor 36. Fold switch 62 is positioned on the front side of one of the upright support legs 12, 14. This positioning avoids an inadvertent folding operation during use of the treadmill and does not require the user to stand on the track bed 10 to fold the treadmill. The incline switch 60 operates the incline motor 36 to adjust the incline while the fold switch 62 operates the incline motor 36 to fold the track bed 10. Preferably, the fold switch 62 is guarded or has a safety mechanism to prevent the inadvertent folding of the track bed 10, when hands, fingers or other obstructions may prevent folding or may be injured. For example, fold switch 62 may be electrically deactivated if the tread drive motor 70 is operating.

A gear train 42 connects the incline motor 36 to a linear actuator 44. Linkages other than the linear actuator may be used. The gear train 42 reduces the rotational speed of the motor 36 to properly operate the linear actuator 44. Preferably, the motor 36, gear train 42 and linear actuator 44 can operate under a one hundred (100) pound load. The incline motor 36, gear train 42 and linear actuator 44 are preferably one integral component.

Linear actuator 44 is a tube and rod combination with acme screw threading for extending and retracting the linear actuator 44. Preferably, the linear actuator 44 has an approximately fourteen (14) inch stroke. In other words, the linear actuator 44 is capable of a fourteen (14) inch length adjustment. Other lengths may be used depending on the length of slot 46 and lever arm 48.

Figure 6:
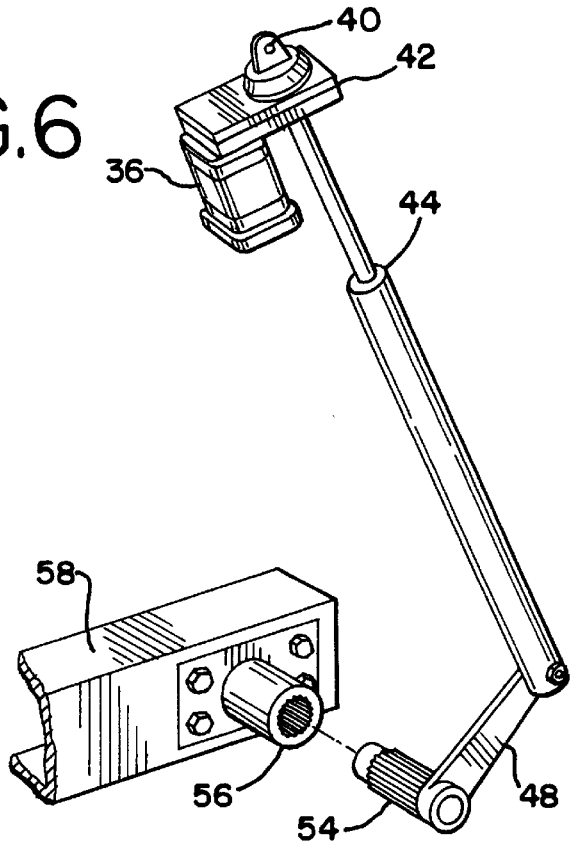
FIG. 6 is a perspective view of a preferred embodiment of the incline motor, linear actuator, lever arm and a portion of the track bed frame assembly.

Linear actuator 44 is rotatably connected to lever arm 48 by a bolt or the like. Lever arm 48 is preferably constructed from steel, and must be strong enough to not fail under the stress and twist exerted by the torque necessary to lift the track bed 10. Since the preferred embodiment uses two lever arms 48, one in each upright support leg 12, 14, the load on each lever arm 48 is reduced. As shown in FIGS. 6 and 7, lever arm 48 preferably has a male spline structure 54 at the end opposite the connection with the linear actuator 44. In one embodiment, the lever arm is approximately six (6) inches long from the center of the male spline structure 54 to the connection with the linear actuator 44.

Male spline structure 54 fits within female spline structure 56, which is bolted to the frame 58 of track bed 10. Preferably, the female spline structure 56 is made of steel tubing. The intermeshing male and female spline structures 54, 56 form a rigid connection between the lever arm 48 and track bed 10. A bolt holds the lever arm 48 to the female spline structure 56. Preferably, the lever arm 48 is connected to the track bed 10 via female spline structure 56 at an approximately fifty (50) degree angle to the track bed 10. The angle allows the linear actuator 44 to extend and the lever arm 48 to pivot without interference from other structures so that the rack bed 10 may reach a fully folded position A.

The female spline structure 56, with the male spline structure 54, is placed through slot 46 (see FIGS. 4 and 5). A plastic spacer 68 minimizes the amount of lever arm 48 movement by aligning the male spline structure 54 with the female spline structure 56. With the two spline structures 54, 56 connected, the track bed 10 is connected to the lever arm 48 through slot 46. Thus, the round exterior of female spline structure 56 is exposed in slot 46. Further, the slot 46 acts to support and guide the track bed 10 as the track bed is raised and lowered.

As shown in FIGS. 3 and 4, in operation, the track bed 10 has three basic positions (A, B and C) with many intermediary positions. The track bed 10 may be relatively horizontal (C), at a maximum incline (B) or in a completely folded position (A). Position B is not shown in FIG. 4. Position B corresponds to lever arm 48 positioned at the top 50 of slot 46.

In the relatively horizontal position C in one embodiment, as shown in solid lines in FIG. 3, the track bed 10 is at a three (3) degree incline. Thus, an individual may use the treadmill to walk or run while the front end is slightly higher than the back end. In this position, male spline structure 54 of lever arm 48 is positioned at the bottom 52 of slot 46, as shown in FIG. 4. The linear actuator 44 is partially extended and the lever arm 48 is positioned as shown at 48 in FIG. 4 at position C. It should be understood that other angles of incline associated with the lever arm 48 in the bottom 52 position may be used and depend on the height of the bottom 52 above the support base 16.

The track bed 10 may also be adjusted to the maximum incline position, shown in phantom lines in FIG. 3 as position B. In the maximum incline position in one embodiment, the track bed 10 is at an eight (8) degree incline. Thus, an individual may use the treadmill to walk or run while the front end 27 is higher than the back end 29. In this position, male spline structure 54 of lever arm 48 is positioned at the top 50 of slot 46. The linear actuator 44 is fully retracted. Either the slot 46 or the stroke of the linear actuator 44 may prevent further incline of the bed 10. Further, other angles of incline associated with the lever arm 48 in the slot top 50 position may be used and depend on the height of the slot.

Using the incline switch 60, the track bed 10 incline may be adjusted to various positions between and including the maximum incline and relatively horizontal positions (B and C, respectively). The incline switch 60 is a two-way switch that allows for controlling the incline upward or downward. The incline motor 36 will extend the linear actuator 44 to decrease the incline by lowering the front end 27 of the track bed 10, and will retract the linear actuator 44 to increase the incline by raising the front end 27 of the track bed 10. It should be understood that the incline motor 36 may be operated by any type of switch. Further, a limit switch 67 (see FIG. 4) may be provided to sense when lever arm 48, linear actuator 44 or track bed 10 is in a maximum incline. In this maximum incline position B, the lever arm 48 is positioned at the top 50 of slot 46. The limit switch 67 may cause the incline motor 36 to loose power. Other position sensing circuitry could be used. Limit switch 67 may be placed at various locations, such as along slot 46. Another limit switch 63 (see FIG. 4) can be used to turn off incline motor 36 once the track bed 10 is in the minimum incline position C.

The track bed 10 may also be adjusted to the completely folded position A by using the power of the motor 36. In the completely folded position in one embodiment, as shown in phantom as position A in FIG. 3, the track bed 10 is at a ninety (90) degree incline. An individual may not use the treadmill in this folded position, but the treadmill takes up less floor space and is easier to store. To begin the power folding operation, the track bed 10 is lowered to position C. Male spline structure 54 of lever arm 48 is placed at the bottom 52 of slot 46. The linear actuator 44 is extended to partially extended position C as shown in FIG. 4.

As the linear actuator 44 extends once the lever arm 48 is at the bottom 52 of slot 46, the lever arm 48 begins to rotate and raise the track bed 10. The bottom 52 of slot 46 becomes the pivot point 27 for the rotation. Since lever arm 48 is rigidly attached to track bed 10, the track bed 10 back end 29, including back end support 34, is lifted off of the floor or ground and, thus, folded. The resistance of incline motor 36 acting through the linear actuator 44 operates to hold the track bed 10 in place in any position of the track bed 10 as the bed is being folded. Preferably, linear actuator 44 is extended to fully extend position A (FIG. 4) to place track bed 10 in a fully folded position A (FIG. 3).

Fold switch 62 may be used to actuate the incline motor 36. Preferably, fold switch 62 is a momentary switch. Once fold switch 62 is switched, the incline motor 36 will decrease any incline until the lever arm 48 is at the slot bottom 52. The incline motor 36 will continue to extend the linear actuator 44 until the switch or any logic is operated to stop the treadmill from folding any further. Upon reaching the completely folded position, the linear actuator 44 is preferably fully extended and stops the track bed 10 from folding any further. A limit switch 65 (see FIG. 4) in the upright support 12 may also sense the position of lever arm 48 or linear actuator 44 and cause the incline motor 36 to turn off. Limit switch 65 may be positioned in any location allowing the position of the track bed 10, lever arm 48 or linear actuator 44 to be determined. Alternatively, positioning circuitry that senses incline motor 36 rotations may also be used.

Fold switch 62 can be activated again to lower the bed 10 from a folded position to a use position. The incline motor 36 will retract the linear actuator 44 until the lever arm 48 is at an angle which places the back end support 34 on the ground or floor as shown in position C. If the user does not deactivate the fold switch 62, a limit switch 63 (see FIG. 4) in the upright support 12 will turn the incline motor 36 off. The limit switch 63 senses the position of lever arm 48. Further, the limit switch 63 may be deactivated once the track bed 10 is in a use position so that the incline and decline adjustments may be made without the limit switch 63 turning off the incline motor 36. Alternatively, limit switch 63 may be used as discussed above for operation of incline switch 60. Limit switch 63 may be positioned at any location, such as along slot 46, allowing the switch to sense the position of track bed 10, lever arm 48 or linear actuator 44 position.

Other components may be used on the treadmill, as known in the art. Such components may include a potentiometer for displaying the amount of incline, programmable logic for controlling a user's workout, or pulse readers. Further, to reduce the load on the incline motor 36 and to allow use of a smaller motor, gas shocks may be used to assist in folding and unfolding the track bed.

Figure 8:
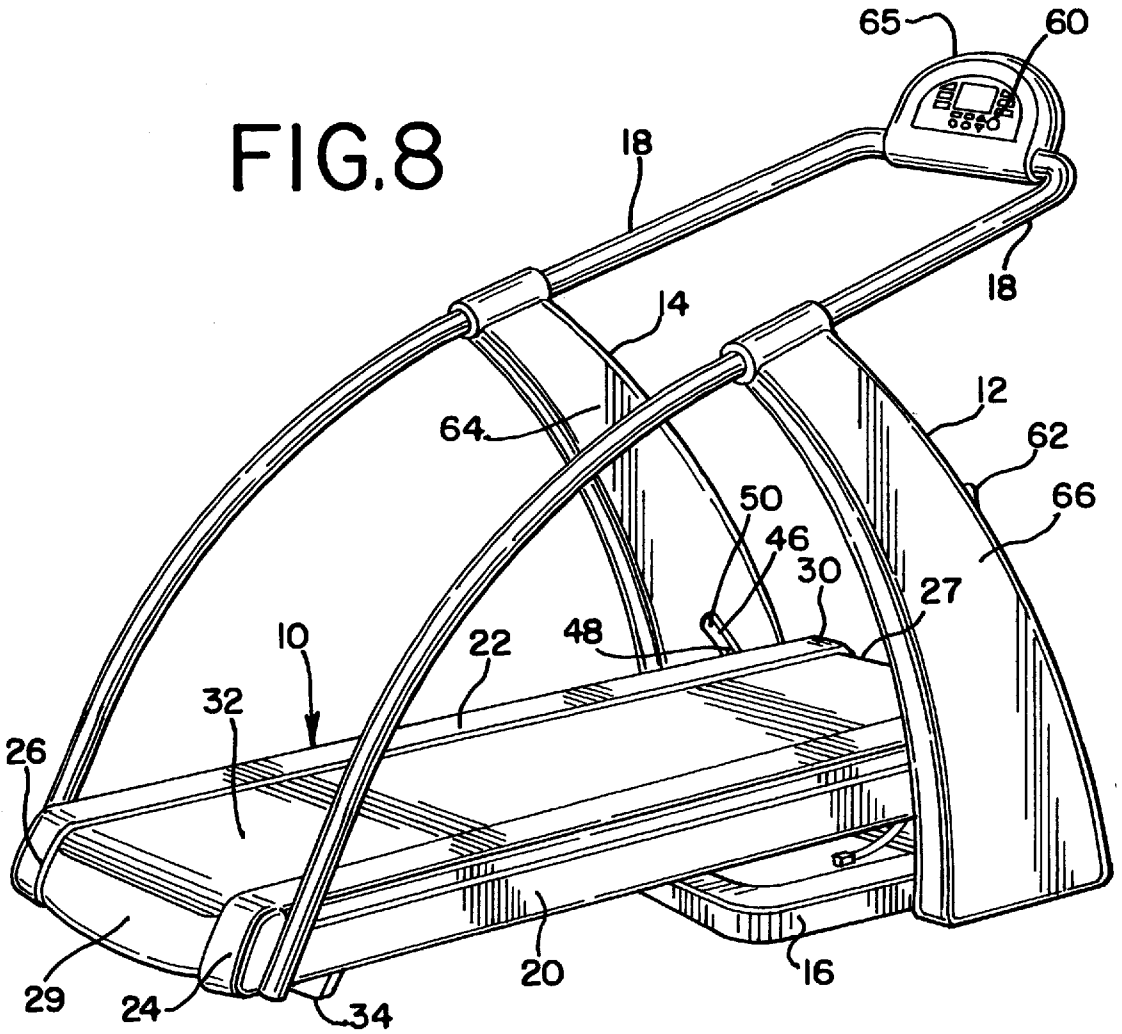
FIG. 8 is a perspective view of an alternative preferred embodiment of the invention.

In another embodiment as shown in FIG. 8, the system for linking the track bed 10 to the upright supports 12, 14 are shown in a non-powered, folding treadmill. The non-powered, folding treadmill, in one embodiment, has many of the same structures as the above-discussed treadmill. However, the incline adjustment is positioned under the track bed 10 on the track bed front end as known in the art. A motor with a lever arm and ground-engaging wheel system, for example, could be used. The incline adjustment raises and lowers the track bed 10 to adjust the incline, but does not raise or lower the treadmill, such as base support 16 or upright supports 12, 14. As discussed above, a slot 46 is provided in both upright supports 12, 14. Lever arm 48 or another extension from track bed 10 is positioned in slot 46. As the incline is adjusted, lever arm 48 is adjusted within the slot 46.

In the preferred arrangement of the embodiment shown in FIG. 8, the handle bar 18 extends to the back end of track bed 10 on both sides of the treadmill. The track bed 10 is connected to the handle bar 18 by an interlocking tube receptacle that provides a solid connection capable of easy disconnection. In preparation for folding the treadmill, the handle bar 18 or at least the portion of the handle bar 18 that extends from the upright supports 12, 14 to the track bed 10 is removed. Preferably, a quick disconnect is provided on the upright supports 12,14. Alternatively, a bolt or screw system could be used.

To fold the treadmill shown in FIG. 8, the incline of track bed 10 is adjusted to the least inclined position. The least inclined position corresponds to the lever arms 48 in upright supports 12, 14 being positioned at the slot bottom 52 (position 6 in FIG. 3). Preferably, the incline adjustment raises the ground engaging wheels off of the ground or floor. The back end of track bed 10 may then be lifted to fold the treadmill. The lever arm 48 pivots in slot 46. Gas shocks, such as disclosed in application Ser. No. 08/647,620 to Bruce F. Coody and Greg Harris, filed on May 13, 1996, the disclosure of which is herein incorporated by reference, may be used to assist the folding of the track bed 10. The gas shocks are attached between lever arms 48 and upright supports 12, 14 inside the upright supports 12, 14. The gas shocks are filled with an inert gas, such as nitrogen gas, and operate to assist in the raising of track bed 10.

Many alterations to the preferred embodiment may be made while still using the invention. For example, a different motor may be used for incline adjustments and folding adjustments. Further, the different motor or even the incline motor may be placed somewhere other than the upright support, such as the base support, and still provide power folding. As another example, the incline adjustment structure on a foldable treadmill may be placed on the back end 29 of track bed 10 with a powered fold provided on the front or back end 27 or 29.

It is the following claims, including all equivalents, which are intended to define the scope of this invention.

We claim:

1. A foldable treadmill comprising:

a support;

a track bed comprising a front end and a back end, the track bed front end disposed pivotally to the support; and a motor operatively connected to the support and operatively connected to the track bed and operable to raise the track bed into a folded position with respect to said support.

2. The treadmill of claim 1 wherein a linear actuator operatively connects the motor to the track bed.

3. The treadmill of claim 1 wherein the track bed has a lever arm member and the motor pivotally connects to the lever arm member.

4. The treadmill of claim 1 wherein the support has a slot and the track bed is pivotally disposed adjacent to the support at the slot.

5. The treadmill of claim 3 wherein the support has a slot and the lever arm is pivotally disposed in the slot.

6. The treadmill of claim 5 wherein a linkage member operatively connects the motor to the lever arm.

7. The treadmill of claim 6 wherein the linkage member extends to at least a first, a second and a third linkage position.

8. The treadmill of claim 7 wherein the track bed has at least a first incline position corresponding with the first linkage position, a second incline position corresponding with the second linkage position, and a third linkage position corresponding with the folded track bed position.

9. The treadmill of claim 8 wherein:

the lever arm is operatively connected to the front end of the track bed; and the folded track bed position corresponds to the raising of the back end of the track bed higher than said front end.

10. The treadmill of claim 9 wherein the folded track bed position corresponds to the track bed in a substantially vertical position.

11. The treadmill of claim 1 wherein:

the support comprises a first and second support;

the motor comprises a first and second motor;

the first motor operatively connects to the first support and operatively connects to the track bed; and the second motor operatively connects to the second support and operatively connects to the track bed.

12. The treadmill of claim 1 wherein the support comprises an upright support.

13. A method of operating a foldable treadmill comprising:

providing a track bed that is pivotally connected at one end to a support; and operating a motor that is operatively connected to the track bed and is operatively connected to the support to fold or unfold the track bed.

14. A foldable treadmill with front incline adjustment comprising:

a support having a slot;

a track bed having a front end and a back end, the track bed front end pivotally connected to the support in said slot for folding the track bed; and an incline adjustment operatively connected to the front end to adjust the incline of said track bed by raising or lowering the front end within said slot, said incline adjustment assists the folding of the treadmill.

* * * * *